US007621286B2

(12) United States Patent
Frei et al.

(10) Patent No.: US 7,621,286 B2
(45) Date of Patent: Nov. 24, 2009

(54) CONVEYOR WARE WASHER AND SPRAY PIPE THEREFOR

(75) Inventors: Gerhard Frei, Ohlsbach (DE); Harald Disch, Elzach (DE); Werner Neumaier, Offenburg (DE); Jürgen Litterst, Appenweier (DE)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 11/389,939

(22) Filed: Mar. 27, 2006

(65) Prior Publication Data

US 2006/0219820 A1 Oct. 5, 2006

(30) Foreign Application Priority Data

Apr. 2, 2005 (DE) ..... 10 2005 015 156

(51) Int. Cl.
*B08B 3/00* (2006.01)

(52) U.S. Cl. ..... 134/129; 134/131; 134/152; 239/548; 239/550; 239/566; 239/561; 239/601

(58) Field of Classification Search ..... 239/548, 239/556, 601, 550, 559, 567, 566, 561; 134/129, 134/131, 144, 152, 153
See application file for complete search history.

(56) References Cited

U.S. PATENT DOCUMENTS

| | | | | | |
|---|---|---|---|---|---|
| 2,270,595 | A | | 1/1942 | Lewis | |
| 2,642,314 | A | * | 6/1953 | Dupasquier | 239/120 |
| 3,212,719 | A | * | 10/1965 | Di Corpo | 239/541 |
| 3,830,691 | A | * | 8/1974 | Truesdale et al. | 162/273 |
| 3,913,845 | A | * | 10/1975 | Tsuji | 239/556 |
| 4,582,259 | A | * | 4/1986 | Hoover et al. | 239/559 |
| 4,706,889 | A | * | 11/1987 | Hofmann | 239/550 |
| 4,709,713 | A | * | 12/1987 | Kuhl | 134/72 |
| 4,735,222 | A | | 4/1988 | Crane et al. | |
| 5,507,877 | A | | 4/1996 | Magsig et al. | |
| 5,571,560 | A | * | 11/1996 | Lin | 427/240 |
| 5,660,196 | A | * | 8/1997 | Bein | 134/129 |
| 5,850,841 | A | * | 12/1998 | Han et al. | 134/86 |
| 6,062,056 | A | * | 5/2000 | Groch | 72/201 |

FOREIGN PATENT DOCUMENTS

| | | |
|---|---|---|
| CN | 1695818 | 11/2005 |
| DE | 24 24 289 | 11/1975 |
| DE | 9209022 | 10/1992 |
| DE | 19535090 A1 | 3/1997 |
| DE | 19608030 C1 | 7/1997 |
| EP | 0 169 764 | 1/1986 |
| EP | 0 174 758 | 3/1986 |
| EP | 0980668 | 2/2000 |
| GB | 2019204 | 10/1979 |
| WO | WO 9400895 | 5/1994 |

* cited by examiner

*Primary Examiner*—Dinh Q Nguyen
(74) *Attorney, Agent, or Firm*—Thompson Hine LLP

(57) ABSTRACT

Spray pipe of a conveyor ware washer for spraying items to be washed with liquid, comprising a plurality of nozzles, which are arranged one behind another in the longitudinal direction of the pipe, and an inlet, from which liquid can flow in the longitudinal direction of the pipe to the nozzles, characterized in that, at least in the case of two nozzles one following another in the liquid supply direction, the nozzle located closer to the inlet has a nozzle opening with a larger opening cross section than the nozzle adjacent to it further away from the inlet.

11 Claims, 3 Drawing Sheets

CONVEYOR WARE WASHER AND SPRAY PIPE THEREFOR

The invention relates to a spray pipe for conveyor ware washers according to the precharacterizing clause of claim 1 and a conveyor ware washer which has at least one such spray pipe in at least one spray zone.

Conveyor ware washers with spray pipes for spraying cleaning liquid in a cleaning spray zone and for spraying rinsing liquid in a rinsing spray zone are known from the prior art. Conveyor ware washers may be rack conveyor ware washers or flight-type ware washers.

The spray pipes may be positioned in a stationary or movable, for example rotatable, manner. Depending on embodiment, there are spray pipes with liquid supply at one pipe end and spray pipes with liquid supply halfway along the pipe. Liquid supply is also possible at another part length of the spray pipe.

The invention is intended to achieve more even liquid distribution before or at the latest when the spray jets strike the items to be sprayed.

According to the invention, the object is achieved by the features of the independent patent claims.

Further features of the invention are contained in the subclaims.

The invention is described below with reference to the accompanying drawings using preferred embodiments as examples. In the drawings, FIG. 1 shows a portion of a spray pipe according to the invention, partly in longitudinal section;

Figure 1:
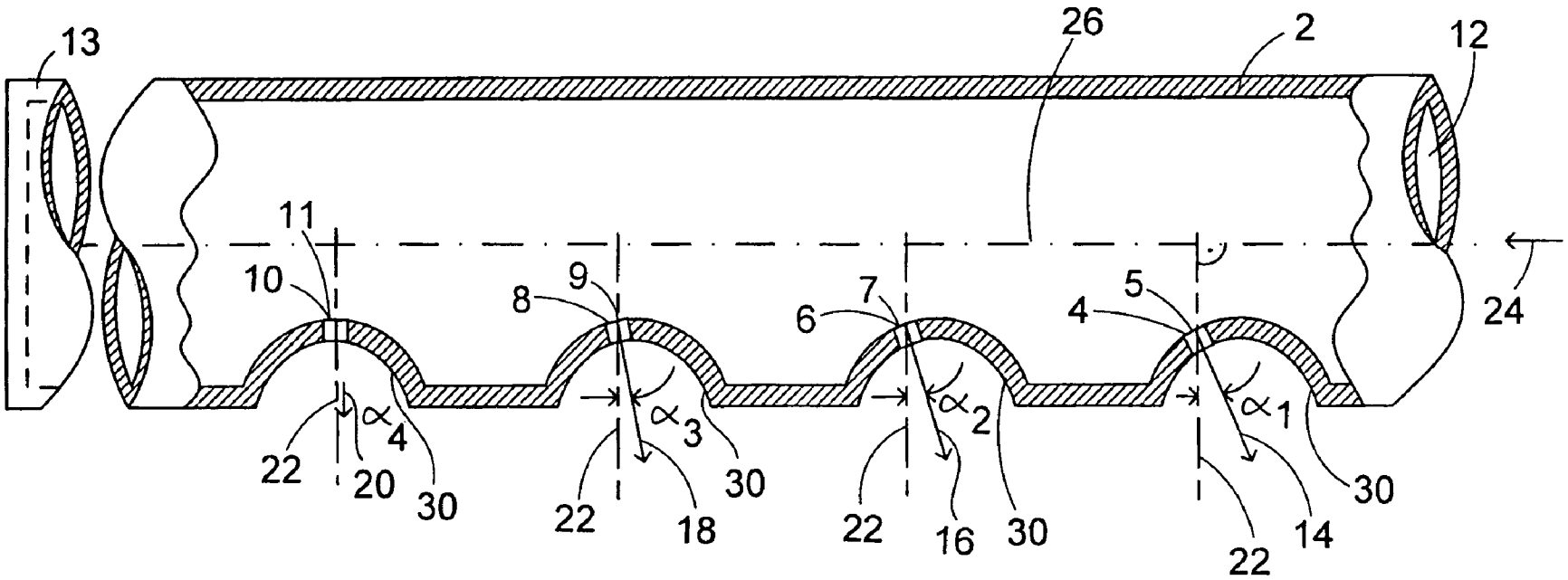

The spray pipe 2 according to the invention shown in FIG. 1 of a conveyor ware washer for spraying items to be washed (plates, trays, cutlery, cups, glasses etc.) with liquid comprises a plurality of nozzles 4, 6, 8, 10, which are arranged one behind another in the longitudinal direction of the pipe. The spray pipe 2 has an inlet 12, from which liquid can flow in the longitudinal direction of the pipe to the nozzles 4, 6, 8 and 10, and a closed pipe end 13 This direction from the inlet 12 to the nozzles 4, 6, 8 and 10 is referred to below as the liquid supply direction 24.

The nozzle opening 5 of at least the nozzle 4 located closest to the inlet 12, preferably of two or more nozzles located successively closest to the inlet 12, has an outlet direction 14 which is inclined obliquely in the opposite direction to the liquid supply direction seen from the inlet 12 to the nozzles 4, 6, 8, 10 at an angle of inclination $\alpha$, for example $\alpha 1$, $\alpha 2$, $\alpha 3$. The angle $\alpha$ is defined between the outlet direction 14 of the nozzle opening 5 and a theoretical transverse plane 22 which extends at right angles to the liquid supply direction 24.

FIG. 1 show an embodiment in which the first three nozzle openings 5, 7 and 9 following the inlet 12 have an outlet direction 14, 16 and 18 respectively which extends obliquely in the opposite direction to the liquid supply direction 24 at an angle $\alpha 1$, $\alpha 2$ and $\alpha 3$ respectively. These three inclined nozzle openings can all have the same angle of inclination, but, according to the preferred embodiment of the invention, the angle of inclination decreases from nozzle to nozzle seen in the liquid supply direction 24, so that the angle of inclination $\alpha 1$ of the first nozzle opening 5 is the largest, lying between 8° and 16° for example, the angle of inclination $\alpha 2$ of the second nozzle opening 7 is smaller and preferably lies between 3° and 10°, and the angle of inclination $\alpha 3$ of the third nozzle opening 9 is smaller again and lies between 0° and 5° for example. The nozzle openings following then in the liquid supply direction preferably all have an outlet direction 20 at right angles to the liquid supply direction 24, so that here the angle of inclination $\alpha 4$ is 0°.

The liquid supply direction 24 extends parallel to the axial pipe centre line 26 of the spray pipe 2. The spray pipe can have over its entire length a uniform internal cross section or a varying internal cross section. The spray pipe 2 can have a circular pipe cross section or a cross-sectional shape which differs from circular.

The nozzle openings 5, 7, 9 and 11 can each have a circular opening cross section or an opening cross section which differs from circular, and can be an elongated hole for example.

The nozzle openings of the nozzles 4, 6, 8 and 10 can be nozzle elements inserted into the spray pipe 2 with nozzle openings formed in them or can be holes formed in the spray pipe 2 according to FIG. 1.

The nozzles 4, 6, 8, 10 and thus their nozzle openings 5, 7, 9 and 11 as well are preferably arranged in recesses 30 of the outer surface of the spray pipe 2. In this connection, the nozzle openings 5, 7, 9 which are inclined obliquely counter to the liquid supply direction 24 are in each case located in the rear sloping recess portion, seen in the liquid supply direction 24, of a recess 30. The nozzle openings 11 of the nozzles 10 which are arranged at right angles to the liquid supply direction 24 are preferably located in the deepest part of the recess 30. The recesses 30 are preferably concave, round or valley-like curvatures of the pipe wall.

In order that approximately the same amount of liquid flows at least through some of the nozzles 4, 6, 8, 10, the opening cross section of the nozzle opening 5, 7, 9, 11 of the nozzle or of a number of nozzles 4, 6, 8, 10 which is or are arranged closer to the inlet 12 is larger than in the case of the nozzle or nozzles arranged further away from the inlet 12. Preferably, starting from the inlet 12, the first nozzle 4 has the largest opening cross section, the second nozzle 6 has a smaller, second largest opening cross section, the third nozzle 8 has a still smaller, third largest opening cross section etc. According to another embodiment, a group of two or more nozzles lying closer to the inlet 12 can also each have a larger opening cross section than the nozzle or group of nozzles following in the liquid supply direction 24. The principle consists in having gradually smaller opening cross sections of the nozzles starting from the inlet 12, at least in the initial portion of the nozzle row.

Figure 2:
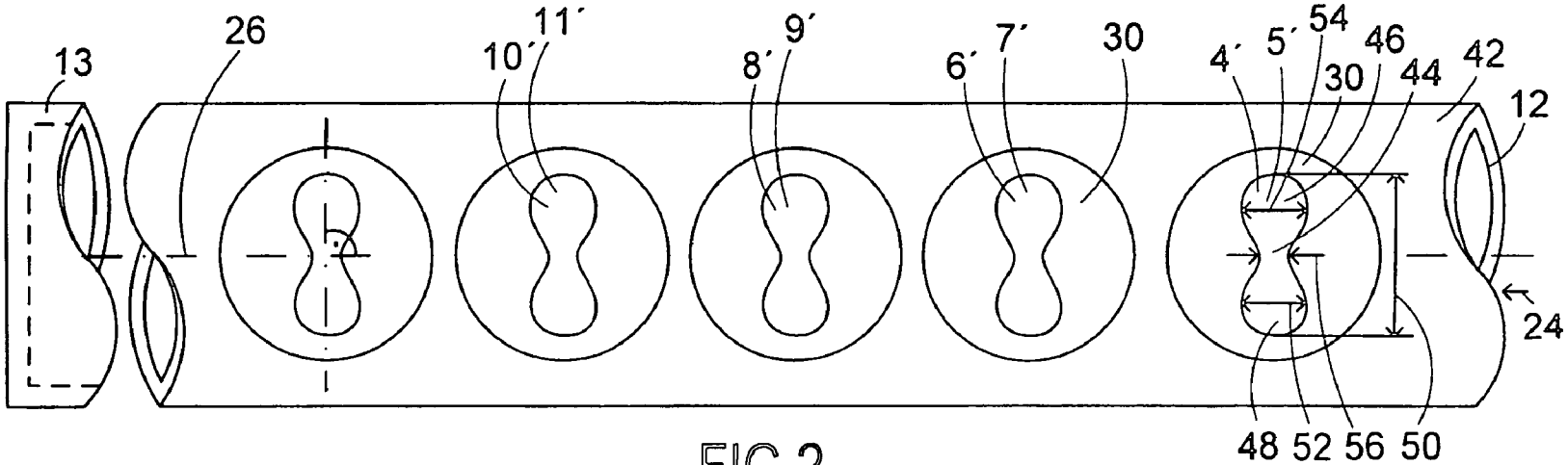
FIG. 2 shows a side view of a portion of a spray pipe according to another embodiment according to the invention.

FIG. 2 shows a spray pipe 42 according to the invention, in which the nozzle openings 5', 7', 9', 11' of the nozzles 4', 6', 8', 10' are elongated holes, which have a constriction preferably of the same size on both sides in the central region 44 of their longitudinal extent where the nozzle opening has a smaller width than in each of the two adjacent end regions 46 and 48.

The elongated holes 5', 7', 9', 11' of the nozzles 4', 6', 8', 10' each have a length 50, a width 52 in the end regions and a constriction width 56 in the central elongated hole region.

According to a preferred embodiment, the elongated hole of the first nozzle opening 5' has a length of 12 mm for example, a width in the end regions 52 of in each case 4 mm and a constriction width 56 of 3 mm for example.

The second elongated hole 7' in the liquid supply direction 24 has, for example, an elongated hole length 50 of 12 mm, a hole width in the end regions 52 of 4 mm and a constriction width in the central region 56 of 2.5 mm.

The third elongated hole 9' in the liquid supply direction 24, of the third nozzle 8', has an elongated hole length 50 of 10 mm for example, an elongated hole width in the two end regions 52 of in each case 4 mm and a constriction width in the central region 56 of 2.5 mm for example. The elongated hole following then of the nozzle opening 11' of the nozzle 10' has the same dimensions as the preceding nozzle opening 9' for example. Elongated holes following then of nozzle openings have an elongated hole width in the end regions 52 of in each case 4 mm and a constriction width in the central region 56 of 2 mm for example.

Figure 3:
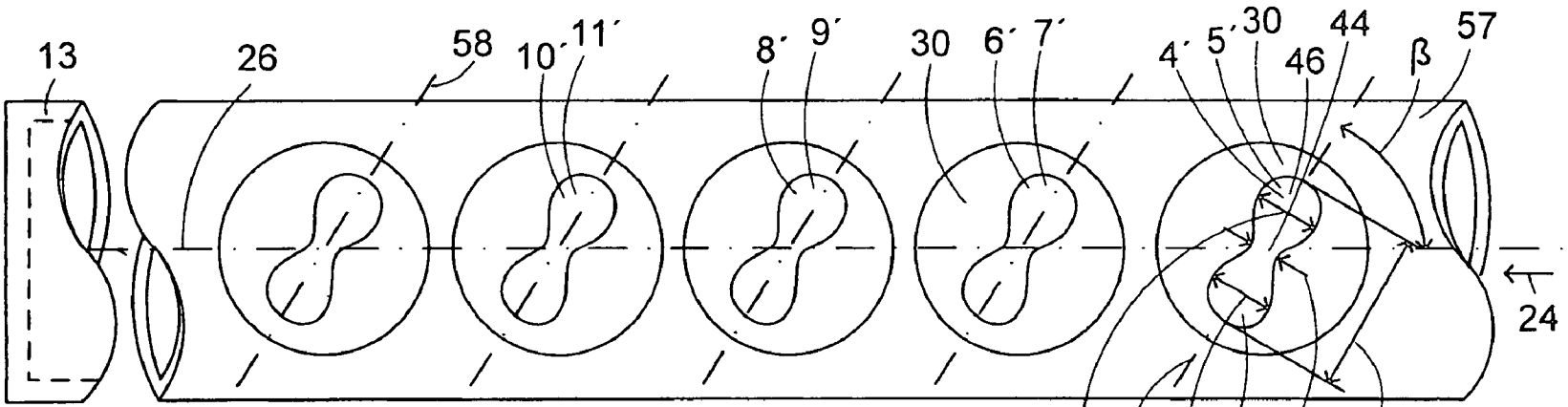
FIG. 3 shows a side view of a portion of a spray pipe according to yet another embodiment of the invention.

FIG. 3 shows another preferred embodiment of a nozzle pipe 57 according to the invention, according to which the longitudinal axis 58 of the elongated holes from FIG. 2, seen in a side view of the pipe, does not enclose an angle of 90° relative to the axial pipe centre line 26 as in FIG. 2 but a smaller angle β in the range between 85° and 50° for example, preferably between 65° and 75°.

With elongated holes, the spray jet fan sprayed from them rotates by approximately 90° about the spray jet centre line relative to the elongated hole axis 58.

Figure 4:
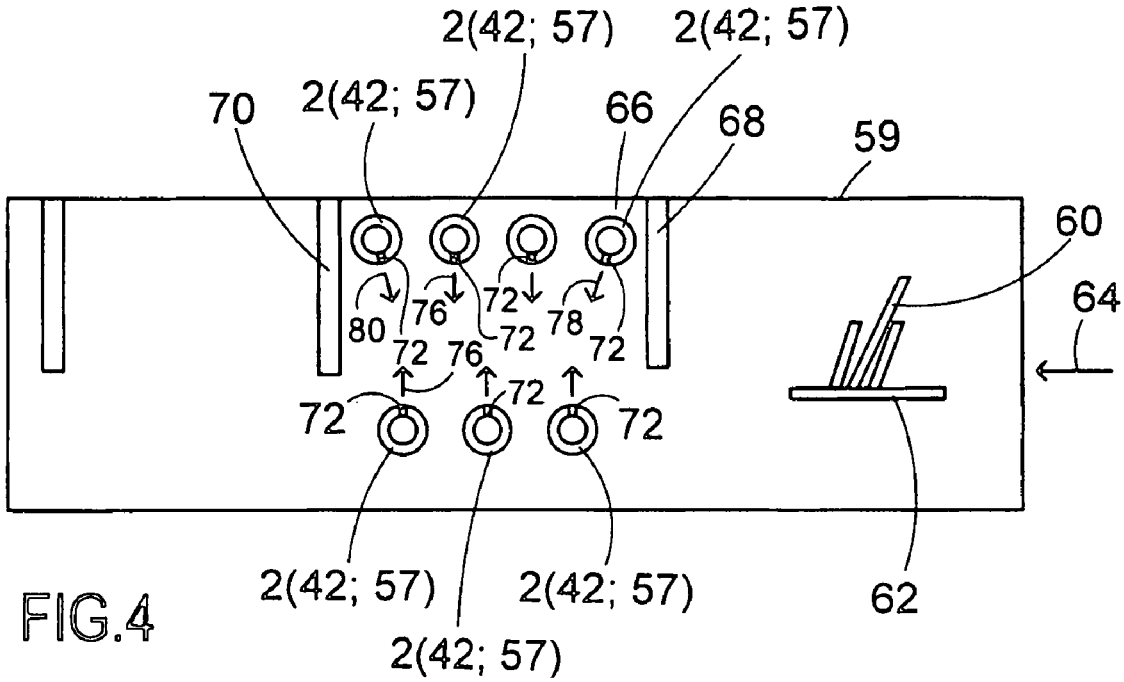
FIG. 4 shows diagrammatically and not to scale a longitudinal section through a conveyor ware washer according to the invention.

FIG. 4 shows diagrammatically in longitudinal section a conveyor ware washer according to the invention, in which a group of a number of upper spray pipes 2 or 42 or 57 according to the invention are arranged with their nozzles directed downwards and a lower group of spray pipes 2 or 42 or 57 according to the invention are arranged with their nozzles directed upwards. The items to be washed 60 are conveyed through the conveyor ware washer 59 in the conveying direction 64 by a conveying device 62. At the front and rear end of the spray zone 66, in which the spray pipes 2 or 42 or 57 are located, curtains 68 and 70 respectively, in the form of rubber flaps or fabric flaps for example, are arranged for delimiting the climate in the spray zone 66. The spray zone 66 illustrated may be a cleaning spray zone for cleaning items to be washed or a rinsing zone for rinsing items being washed.

In FIG. 4, to simplify the illustration, the nozzles 4 to 10 described above and their nozzle openings 5 to 11 and the nozzles 4' to 10' described above and their nozzle openings 5' to 11' are in each case combined under reference number 72.

According to the preferred embodiment of the invention shown in FIG. 4, the spray pipes 2 (or 42 or 57) are arranged at right angles to the conveying direction 64 of the items to be washed 60 in a spray zone 66. In the case of the first upper spray pipe 2 (or 42 or 57) of the spray zone 66 in the conveying direction 64, the nozzle openings 72 are, deviating from the vertical direction 76, directed obliquely forwards in the conveying direction 64, as is illustrated diagrammatically by an arrow 78. In the case of the last upper spray pipe 2 (or 42 or 57) of the spray zone 66 in the conveying direction 64, the nozzle openings 72 are, deviating from the vertical direction 76, directed obliquely backwards counter to the conveying direction 64, as is illustrated diagrammatically by an arrow 80. The spray pipes adjacent to the first spray pipe and to the last spray pipe can be aligned obliquely in the same way but preferably to a lesser extent. FIG. 4 shows an embodiment in which the nozzle openings 72 of the central spray pipes 2 (or 42 or 57) arranged between the outer upper washing pipes are aligned in the vertical direction 76. The nozzle openings 72 of the lower spray pipes 2 (or 42 or 57) can all be aligned vertically according to FIG. 4, or their first spray pipe and their last spray pipe can be rotated slightly corresponding to the upper spray pipe group, so that their nozzle openings 72 are directed obliquely in relation to the vertical direction 76 in the direction towards the centre of the spray zone 66, similarly to the arrows 78 and 80 of the front and rear upper spray pipes.

Figure 5:
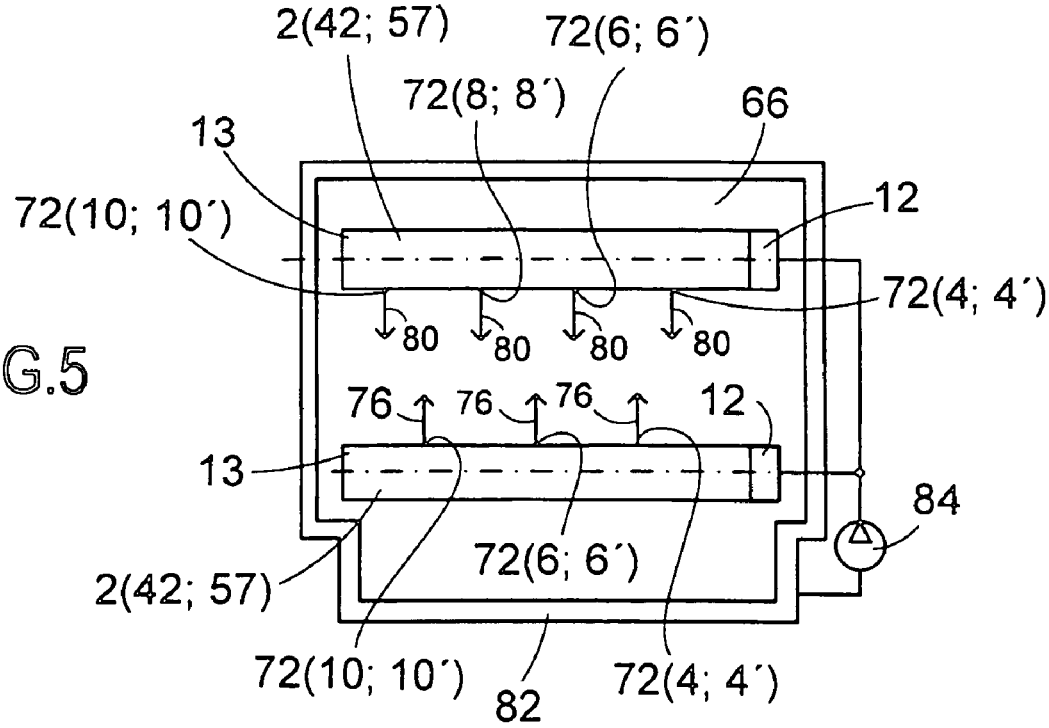
FIG. 5 shows diagrammatically and not to scale an end view of a spray zone of the conveyor ware washer in FIG. 4.

FIG. 5 shows diagrammatically an end view of the conveyor ware washer in FIG. 4, in which liquid is delivered from a tank 82 to the spray pipes 2 (or 42 or 57) by means of a pump 84.

The invention claimed is:

1. Conveyor ware washer including a conveyor mechanism for carrying items along a conveyor path, a supply of cleaning or rinsing liquid and a spray pipe for spraying items to be washed with liquid, the spray pipe including a plurality of nozzles, which are arranged one behind another in a longitudinal direction of the pipe, and an inlet in communication with the supply of cleaning or rinsing liquid, from which the liquid can flow in the longitudinal direction of the pipe to the nozzles, characterized in that, at least in the case of two nozzles one following another in the liquid supply direction, the nozzle located closer to the inlet has a nozzle opening with a larger opening cross section than the nozzle adjacent to it further away from the inlet;

the nozzle opening of at least the nozzle located closest to the inlet, has an outlet direction which extends obliquely in a direction opposite to the liquid supply direction seen from the inlet to the nozzles at an angle of inclination, the angle of inclination being defined between the outlet direction of the nozzle opening and a transverse plane which extends at right angles to the liquid supply direction;

the nozzle opening of at least two successive nozzles is inclined obliquely in the opposite direction to the liquid supply direction, the angle of inclination of the following nozzle being smaller than the angle of inclination of the preceding nozzle.

2. A conveyor ware washer, comprising: at least one spray zone, at least one spray pipe extending across the conveyance path in the spray zone, the spray pipe configured with a plurality of nozzles arranged along a longitudinal direction of the spray pipe, a supply of cleaning or rinsing liquid, and an inlet in communication with the supply of cleaning or rinsing liquid, from which the liquid can flow in the longitudinal direction of the pipe to the plurality of nozzles, wherein at least in the case of a first nozzle and a second nozzle, the second nozzle follows the first nozzle in the longitudinal direction and the first nozzle is located closer to the inlet, the first nozzle has a nozzle opening with a larger opening cross section than a nozzle opening of the second nozzle;

wherein the nozzle opening of at least the first nozzle has an outlet direction that extends at a first oblique angle back toward an inlet end of the spray pipe, the first oblique angle being defined between the outlet direction of the nozzle opening and a transverse plane that extends at right angles to the longitudinal direction;

wherein the nozzle opening of the second nozzle has an outlet direction that extends at a second oblique angle back toward the inlet end of the spray pipe, the second oblique angle being defined between the outlet direction of the nozzle opening and a transverse plane which extends at right angles to the longitudinal direction, the second oblique angle being smaller than the first oblique angle;

wherein a third nozzle has an opening with an outlet direction that extends at a right angle to the longitudinal direction.

3. A conveyor ware washer, comprising:

a conveyer configured to move objects placed upon the conveyer along a conveyance path in a conveyance direction;

at least one spray zone along the conveyance path;

a supply of cleaning or rinsing liquid; and at least one spray pipe extending across the conveyance path in the spray zone, the spray pipe disposed along a longitudinal direction substantially transverse to the conveyance direction, the spray pipe including:

a plurality of nozzles arranged along the longitudinal direction of the spray pipe;

an inlet in communication with the supply of cleaning or rinsing liquid, from which the liquid can flow in the longitudinal direction of the pipe to the plurality of nozzles;

wherein the nozzle that is closest to the inlet has an outlet direction that extends at a first oblique angle back toward the inlet, the first oblique angle being defined between the outlet direction of the nozzle opening and a transverse plane that extends at right angles to the longitudinal direction;

wherein the nozzle that is furthest from the inlet has an outlet direction that is perpendicular to the longitudinal direction.

4. The conveyor ware washer of claim 3:

wherein each nozzle located between the nozzle that is closest to the inlet and the nozzle that is furthest from the inlet has an outlet direction at an angle defined between the outlet direction of the nozzle opening and the transverse plane that extends at right angles to the longitudinal direction, the angle of each nozzle located between the nozzle that is closest to the inlet and the nozzle that is furthest from the inlet being no greater than the angle of any other nozzle that is closer to the inlet and no less than the angle of any other nozzle that is further from the inlet.

5. The conveyer ware washer of claim 3, wherein the spray pipe includes a series of semispherical concave recesses, and wherein each nozzle of the plurality of nozzles is an opening within a different semispherical concave recess such that the location of each nozzle within its recess determines the angle of the outlet direction of each nozzle.

6. A conveyor ware washer, comprising:

a conveyer configured to move objects placed upon the conveyer along a conveyance path in a conveyance direction;

at least one spray zone along the conveyance path;

a supply of cleaning or rinsing liquid; and at least one spray pipe extending across the conveyance path in the spray zone, the spray pipe disposed along a longitudinal direction substantially transverse to the conveyance direction, the spray pipe including:

a plurality of nozzles arranged along the longitudinal direction of the spray pipe;

an inlet in communication with the supply of cleaning or rinsing liquid, from which the liquid can flow in the longitudinal direction of the pipe to the plurality of nozzles;

wherein each nozzle has a corresponding outlet direction, the outlet direction of multiple nozzles of the plurality is offset at an outlet direction angle from a transverse plane that extends at right angles to the longitudinal direction, the outlet direction angle of each nozzle of the multiple nozzles being no greater than the outlet direction angle of any other nozzle that is closer to the inlet and no less than the outlet direction angle of any other nozzle that is further from the inlet.

7. The conveyor ware washer of claim 6 wherein the nozzle that is furthest from the inlet has an outlet direction that is perpendicular to the longitudinal direction.

8. The conveyor ware washer of claim 7 wherein multiple nozzles include an outlet direction angle that is oblique and extends back toward the inlet of the spray pipe.

9. The conveyor ware washer of claim 8 wherein at least in the case of two nozzles one following another in the longitudinal direction, the nozzle located closer to the inlet has a nozzle opening with a larger opening cross section than the nozzle adjacent to it further away from the inlet.

10. The conveyer ware washer of claim 9, wherein the spray pipe includes a series of semispherical concave recesses, and wherein each nozzle of the plurality of nozzles is an opening within a different semispherical concave recess such that the location of each nozzle within its recess determines the outlet direction angle each nozzle.

11. A spray pipe for a conveyor ware washer for spraying items to be washed with liquid, comprising:

an elongated body;

a plurality of nozzles arranged along a longitudinal direction of the elongated body;

an inlet for receiving liquid, from which the liquid can flow in the longitudinal direction of the pipe to the plurality of nozzles;

wherein the nozzle that is closest to the inlet has an outlet direction that extends at a first oblique angle back toward the inlet, the first oblique angle being defined between the outlet direction of the nozzle opening and a transverse plane that extends at right angles to the longitudinal direction;

wherein the nozzle that is furthest from the inlet has an outlet direction that is perpendicular to the longitudinal direction.

* * * * *